US005547724A

United States Patent [19]

Kuribayashi

[11] Patent Number: 5,547,724

[45] Date of Patent: Aug. 20, 1996

[54] DEVELOPER CARRYING MEMBER, DEVELOPING DEVICE UNIT

[75] Inventor: Tetsuya Kuribayashi, Tokyo, Japan

[73] Assignee: Canon Kabushiki Kaisha, Tokyo, Japan

[21] Appl. No.: 513,597

[22] Filed: Aug. 10, 1995

Related U.S. Application Data

[63] Continuation of Ser. No. 193,776, Feb. 10, 1994, abandoned, which is a continuation of Ser. No. 590,804, Oct. 1, 1990, abandoned.

[30] Foreign Application Priority Data

Oct. 2, 1989 [JP] Japan ..... 1-255184
Oct. 4, 1989 [JP] Japan ..... 1-257651

[51] Int. Cl.[6] ..... G03G 15/09

[52] U.S. Cl. ..... 428/35.8; 428/36.9; 428/402; 118/651; 118/657; 118/658; 355/270; 355/259

[58] Field of Search ..... 428/35.8, 36.9, 428/402; 118/651, 657, 658; 355/270, 259

[56] References Cited

U.S. PATENT DOCUMENTS 4,034,709 7/1977 Fraser et al. ..... 118/658
4,057,666 11/1977 Drummund ..... 428/35
4,616,918 10/1986 Kohyama et al. ..... 355/3 DD
4,764,841 8/1988 Brewingtor et al. ..... 361/266
4,989,044 1/1991 Nishimura et al. ..... 355/251

FOREIGN PATENT DOCUMENTS 1025249C 4/1989 China ..... G03G 15/09
399944 11/1989 European Pat. Off. .
0339944 11/1989 European Pat. Off. ..... G03G 15/09

*Primary Examiner*—Charles R. Nold
*Attorney, Agent, or Firm*—Fitzpatrick, Cella, Harper & Scinto

[57] ABSTRACT

A developer carrying member comprises a substrate and a coating film. The surface of the substrate is covered with the coating film, and the coating film is formed with a film-forming composition. The film-forming composition contains graphite, a carbon black or a mixture thereof; a spherical material having a number average particle diameter of from 0.05 to 30μ; and a binder resin.

60 Claims, 2 Drawing Sheets

DEVELOPER CARRYING MEMBER, DEVELOPING DEVICE UNIT

This application is a continuation of application Ser. No. 8/193/776 filed Feb. 10, 1994, now abandoned; which in turn, is a continuation of application Ser. No. 07/590,804, filed Oct. 1, 1990, now abandoned.

BACKGROUND OF THE INVENTION

1. Field of the Invention

The present invention relates to a developer carrying member used in image forming apparatus such as electrophotographic recording apparatus and electrostatic recording apparatus. More particularly, it relates to a technique for surface modification of a developer carrying member used in a developing device.

2. Related Background Art

The methods as disclosed in U.S. Pat. No. 2,297,691, Japanese Patent Publications No. 42-23910 and No. 43-24748, etc. are hitherto known as electrophotography. In general, copies are obtained by forming an electrostatic latent image on a photosensitive member, utilizing a photoconductive material as a photosensitive layer and according to various means, subsequently developing the latent image by the use of a toner, and transferring the toner image to a transfer medium such as paper if necessary, followed by fixing of the toner image by the action of heat, pressure, heat-and-pressure, or solvent vapor.

Various processes are also known in which an electrostatic latent image is formed into a visible image by the use of a toner.

For example, known development processes include magnetic brush development as disclosed in U.S. Pat. No. 2,874,063, cascade development as disclosed in U.S. Pat. No. 2,618,552, powder cloud development and fur brush development as disclosed in U.S. Pat. No. 2,221,776, and liquid development.

In these development processes, dry development, in which a toner is used in a powdery state, is widely put into practical use in view of its readiness in handling of a developer.

As a developer carrying member used in the dry development, Japanese Patent Application Laid-open No. 57-66455 discloses an example. It is known to mold a metal such as aluminum, nickel or stainless steel, or an alloy compound thereof, into a cylindrical form and treat its surface by electrolysis, blast finishing or by means of sand paper or the like so as to have a given surface roughness.

Such a developer carrying member is inexpensive and can give a relatively stable and high-quality image, but on the other hand makes it difficult to control the static charge of toner when a one-component type developer is used in which static charge is imparted from a developer carrying member. Although various approaches to improvement have been made from the direction of developers, the problem concerning a static charge non-uniformity has not been completely settled.

As disclosed in Japanese Patent Application Laid-open No. 61-180267, it has been proposed to coat the surface of a developer carrying member with a conductive film-forming composition containing a texture-forming agent or constitute a developer carrying member with the same material as a film-forming composition.

In these methods, however, the problems have not been well settled with respect to one-component type magnetic developers.

The reasons therefor are as follows. Because of the developer contains a substance such as a magnetic material having a relatively low resistance, charges tend to slip away and the static charge tends to become non-uniform. Also, because the developer contains an inorganic material such as a magnetic material with a high hardness, the abrasion of a coating film is accelerated. Thus, it is difficult to stabilize image quality.

The above phenomenon is particularly remarkable in a production process in which a coating film is formed using a liquid or pasty coating composition, as is seen in the process disclosed in Japanese Patent Application Laid-open No. 52-119651.

In the case of the liquid or pasty coating composition, such a phenomenon is due to the fact that there is a period of time during which a pigment is movable through the inside of the coating film (i.e., a tack-free time) and hence the surface of the developer carrying member tends to become smooth because of the surface tension or the compatibility of materials.

In Japanese Patent Application Laid-open No. 60-80876, it is proposed to coat the surface of the developer carrying member with a film-forming composition having a conductivity or constitute a developer carrying member with the same material as a film-forming composition.

This method also, however, has not achieved sufficient image stability to duration of copying on a large number of sheets. As a durability test proceeded, it was seen that image density rose (became higher) or fell (became lower) and thus the image density was not stable.

It is presumed that this has been caused by a change of the state in which a pigment having a conductivity projects on the surface of the coating film.

The projection of the pigment is relatively small because of the surface tension of materials and the compatibility of materials when the developer carrying member is in the initial state. As the durability test proceeds, however, the surface layer of the developer carrying member is scraped by a developer, resulting in the formation of a new surface. This is presumed to be the reason. On the other hand, when a substance having a cleavability as exemplified by graphite is used as the pigment, it is seen that the above phenomenon occurs less. This is presumed to be due to the fact that the cleavability of the substance immediately stabilizes the state of the surface.

When, however, graphite is added, the following problems arise.

(1) Since graphite is usually scaly, even a material with an average particle diameter of several microns comprises a particle with a width of several tens of microns in the direction of the major axis (i.e., the direction of the cleavage surface). Even when the ratio of a conductive surface (a pigment surface) to an insulating surface (a resin surface) is in a stable state from a macroscopic viewpoint on the surface of developer carrying member, the ratio is non-uniform from a microscopic viewpoint (i.e. at size level of a developer) and hence the ability of a developer carrying member to impart static charge to a toner becomes non-uniform. This causes a local change of thickness of a toner coat, resulting in a change of density.

(2) Since the cleavage surface is flat, the phenomenon of toner adhesion tends to occur.

The above phenomenon particularly occurs in the production process in which a coating film is formed using a liquid or pasty coating composition according to the method as disclosed in Japanese Patent Application Laid-open No. 52-119651.

In these methods, such a phenomenon is due to the fact that there is a period of time during which pigment in a liquid or pasty coating composition, is movable through the inside of the coating film (i.e., a tack-free time) and hence the surface of the developer carrying member tends to render the surface of a binder resin because of surface tension or compatibility of materials.

SUMMARY OF THE INVENTION

An object of the present invention is to provide a developer carrying member that has solved the above problems.

Another object of the present invention is to provide a developer carrying member that can stably impart static charge to a toner.

Still another object of the present invention is to provide a developer carrying member that can give a toner image stable to duration of copying on a large number of sheets.

A further object of the present invention is to provide a developer carrying member that can stably impart static charge to a toner in any environment.

A still further object of the present invention is to provide a developing device that can stably impart static charge to a toner.

A still further object of the present invention is to provide a developing device that can give toner images stable to duration of copying on a large number of sheets.

A still further object of the present invention is to provide a developing device that can stably impart static charge to a toner in any environment.

To achieve the above objects, the present invention provides a developer carrying member comprising a substrate and a coating film, wherein the surface of said substrate is covered with said coating film, and said coating film is formed with a film-forming composition containing i) a graphite, a carbon black or a mixture thereof, ii) a spherical material having a number average particle diameter of from 0.05 to 30μ and iii) a binder resin.

The present invention also provides a developing device for developing an electrostatic image, comprising an electrostatic image supporting member and a developer carrying member, said developer carrying member comprising a substrate and a coating film, wherein the surface of said substrate is covered with said coating film, and said coating film is formed with a film-forming composition containing i) a graphite, a carbon black or a mixture thereof, ii) a spherical material having a number average particle diameter of from 0.05 to 30μ and iii) a binder resin.

The present invention still also provides a device unit comprising a developing means and a photosensitive member which are integrally joined to form a unit that provides a single unit capable of being freely mounted on and detached from an apparatus main body, said developing means comprising a developer Carrying member, and said developer carrying member comprising a substrate and a coating film, wherein the surface of said substrate is covered with said coating film, and said coating film is formed with a film-forming composition containing i) a graphite, a carbon black or a mixture thereof, ii) a spherical material having a number average particle diameter of from 0.05 to 30μ and iii) a binder resin.

DESCRIPTION OF THE PREFERRED EMBODIMENTS

The developer carrying member of the present invention is used as a developing sleeve in a developing device. The developer carrying member of the present invention comprises a substrate such as a cylindrical aluminum substrate and a coating film that covers the surface of the substrate. The coating film contains i) a graphite, a carbon black or a mixture thereof, ii) a spherical material having a number average particle diameter of from 0.05 to 30 μm and iii) a binder resin.

Figure 1:
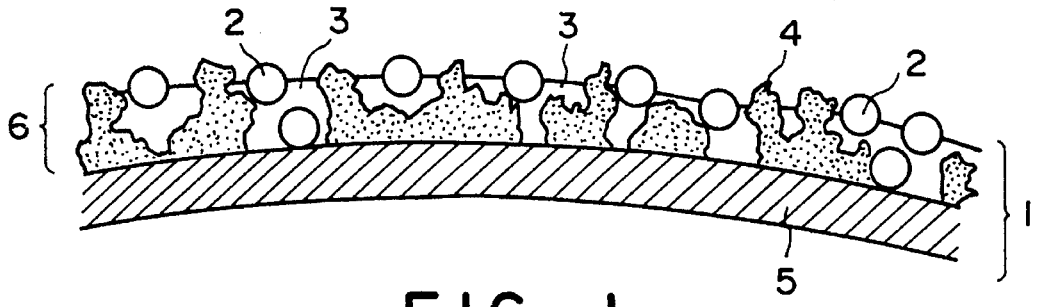
FIG. 1 schematically illustrates a partial cross-section of the developer carrying member of the present invention.

The developer carrying member of the present invention will be described with reference to FIG. 1. In FIG. 1, a developer carrying member 1 comprises a substrate 5 and a coating film 6. The coating film 6 of the developer carrying member 1 shown in FIG. 1 is formed of spherical particles 2, binder resin 3 and graphite 4.

The spherical particles used in the present invention has a number average particle diameter of from 0.05 to 30μ, preferably from 0.05 to 20μ, and more preferably from 0.1 to 10μ. The spherical particles are added for the purpose of preventing the cleavage surface of, e.g., the graphite from becoming smooth. It is added so that the same surface roughness can be retained even when, in particular, the coating film of the developer carrying member has been worn. Spherical particles with a number average particle diameter of less than 0.05μ may bring about no effect of toughening the surface, and spherical particles with a number average particle diameter more than 30μ may result in projection thereof from the coating film, undesirably tending to cause irregular development at that part. What is meant by "spherical" in the present invention is that the ratio of major axis to minor axis of a particle is in the range of from 1.0 to 1.5, and preferably from 1.0 to 1.2. It is particularly preferable for the particles to be perfectly spherical.

Although reasons are not clear at present, in regard to the charge polarity of the spherical particles a positively chargeable material is preferred from the viewpoint of image density. Materials capable of exhibiting positive charge include resin compounds such as a phenol resin, a methyl methacrylate resin (PMMA), a styrene-butadiene copolymer and a nitrogen-containing resin; and metal oxides such as alumina and zinc oxide. The materials are by no means limited to these.

Positive chargeability can be measured by usual static charge measuring methods. For example, it is judged by measuring by the blow-off method the amount of triboelectricity of spherical particles in a mixture comprising spherical particles and metallic powder such as iron powder.

The binder resin used in the coating film provided on the developer carrying member of the present invention includes resins such as a phenol resin, an epoxy resin and a polycarbonate resin. In general, resins capable of imparting to a toner a triboelectric charge in the positive polarity can be preferably used as the binder resin.

Of these resins, thermosetting resins are preferred from the viewpoints of manufacture and durability. From the viewpoint of static charge stability of a toner, a phenol resin is most preferably used. The phenol resin includes a pure phenol resin synthesized from phenol and formaldehyde, and a modified phenol resin comprising the combination of an ester gum with a pure phenol resin. Both of them can be used. The phenol resin is preferably used since it can form a dense three-dimensional cross-linked structure as a result of thermosetting reaction and hence can form a very hard coating film compared with other thermosetting resins such as polyurethanes and polyamides.

As the substrate for the developer carrying member used in the present invention, metals and alloy compounds can be preferably used. Non-metallic materials can also be used.

When, however, the non-metallic material as exemplified by a plastic molded product is used, the substrate must be so formed that it can be electrified, since the developer carrying member (a developing sleeve) is used as an electrode on account of the constitution of the present invention. For example, a metal may be deposited by vacuum deposition on the surface of a non-metallic developer carrying member, or the substrate may be formed of a resin having an electrical conductivity.

The graphite used in the present invention includes natural products and artificial products, either of which can be used.

The particle diameter of the graphite, having a scaly particle form as previously mentioned, can not be sweepingly defined. It is difficult to give the range of particle size of the graphite since its particle form changes when it is dispersed using a stirring means such as a sand mill as will be described later. However, in the present invention, the graphite particle should preferably be not more than 100μ in width in the direction of its major axis (the direction of its cleavage surface).

As a method of measuring the size, most preferred is a method in which a sample is directly observed with a microscope. A simple method is a method in which the size is measured using a conventional particle size distribution meter of an electrical resistance system, a sedimentation system, a centrifugal system, a laser scattering system or the like to determine a maximum value.

The graphite may preferably have a degree of graphitization of not less than 60%. This is because the degree of graphitization is a characteristic having an influence on the readiness of cleavage and also a characteristic presumed to have an influence on the difference in coating film characteristics between their state at the initial stage and their state after duration of copying.

The degree of crystallization can be measured by various methods, and evaluation by X-ray diffraction is a common method, having a good reproducibility.

The carbon black used in the present invention includes a furnace type and a channel type, either of which can be used. Of these, taking account of coating film characteristics, a substance with a lower resistance is preferred. Particularly preferred is carbon black having a resistivity of not more than 0.5 Ω·cm under application of a pressure of 120 $kg/cm^2$.

The weight (W) in which the carbon black is added should preferably satisfy the following equation, which is based on 100 parts by weight of the binder resin.

$$W=[\{100/(\text{oil absorption of carbon black})\}\times 100]\times \underline{a}$$

wherein the oil absorption of carbon black refers to an oil absorption of dibutyl phthalate to 100 g of a sample [cc/100 g], according to ASTM No. D-2414-79; and the coefficient a represents 0.3 to 3.

It is possible to use several kinds of carbon black. In such an instance, the oil absorption may be determined by actually measuring a mixture thereof.

A coefficient a of less than 0.3 can not bring about the effect of adding the carbon black, and a coefficient a more than 3 may undesirably result in a lowering of the hardness of a coating film.

The carbon black may more preferably be added in such an amount that satisfies W in which the coefficient a is 0.5 to 2.

A process for producing the developer carrying member of the present invention will be described below.

The film-forming composition used in the present invention is prepared in the following way. Starting materials for the film-forming composition are added in a solvent capable of dissolving the binder resin, for example, when the phenol resin is used, in a solvent of an alcohol type such as methanol or propyl alcohol, in an amount of from 5 to 50 wt. % based on solids content. Pigment content is dispersed using a stirring mill such as a sand mill, a ball mill or an attritor. An undiluted solution of the film-forming composition is thus obtained. To the resulting undiluted solution of the film-forming composition, a solvent is added so that solids content are controlled to be suited to the production process. A coating solution is thus prepared. The resulting coating solution is applied to the substrate for the developer carrying member, and allowed to become tack-free. Thereafter, the coating film formed is cured by heating or exposure to light. A developer carrying member is thus produced. The coating solution may be applied by spray coating, dip coating, roller coating, bar coating or electrostatic coating.

The component ratio of the respective components used in the present invention will be described below. In the following, particularly preferred ranges are noted.

The weight ratio of the graphite to the binder resin in the present invention is from 2/1 to 1/3. In that range particularly preferable results can be obtained. This is due to a high possibility that a ratio more than 2/1 results in a lowering of film strength, and a ratio less than 1/3 causes an irregular coat of a developer.

The spherical particles used in the present invention may be added in an amount of from 1 to 20 wt. % based on the weight of the binder resin, in the range of which particularly preferable results can be obtained. An amount less than 1 wt. % may bring about a small effect of adding the spherical particles, and an amount more than 20 wt. % may often affect the development performance.

In the present invention, the following additive materials may be further added to the coating film. A conductive material may be added in order to control the resistance of the coating film. Such a conductive material includes conductive carbons such as acetylene black and oil black; metals such as iron, lead and tin; and metal oxides such as tin oxide and antimony oxide. These may be added in an amount such that the ratio of the additive materials to the binder resin ranges from 2/1 to 1/3. A charge controlling agent used in toners may also be added to the coating film for the purpose of more stabilizing the static charge of a toner. Such an agent includes, for example, quaternary ammonium salts, boric acid Compounds and phosphoric acid compounds. In any of the instances, addition of the spherical particles having a number average particle diameter of form 0.05 to 30μ, and preferably from 0.005 to 20μ, makes it possible to retain a stable surface of the developer carrying member.

The developer carrying member in the present invention may have a surface roughness in the range of from 0.2 to 5.0, and preferably from 0.3 to 3, as an area average value (hereinafter "Ra"), and also in the range of from 0.5 to 2.0 as the rate of change in surface roughness due to duration of copying (i.e., surface roughness after duration of copying to that of initial stage). A surface roughness less than 0.2 may undesirably result in a lowering of carrying ability, and a surface roughness more than 5.0μ results in an excessively large thickness of a developer coat, undesirably making flying and irregular development conspicuous. The rate of change in surface roughness is measured for the purpose of confirming that the surface roughness achieved by the present invention changes only a little after a period of copying.

As to the surface of the developer carrying member, the relation between a mean pitch of roughness (Sm), which is the mean space between concavities and convexities on the surface of the coating film, and an average particle diameter ($\bar{d}$) of toner of a developer have should be $Sm/\bar{d}=1/10$ to 10, and preferably 1/5 to 5, and the surface roughness (Ra) of the coating film should be 0.3 to 3 μm, and preferably 0.5 to 3 μm.

The two values in lengthwise direction (Sm value) and heightwise direction (Ra value) are used as values that represent the state of the surface. Here, an $Sm/\bar{d}$ value smaller than 1/10 can not bring about the effect of toughening, and a value larger than 10 results in an approximation to a smooth surface with respect to toner size, also bringing about no effect of toughening.

Figure 4:
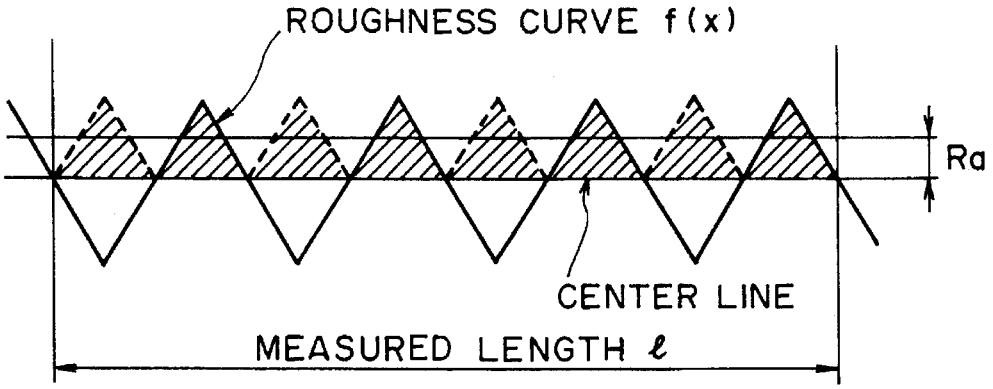
FIG. 4 is an illustration concerning the center line average roughness (Ra) of the surface of a developer carrying member.

In the present invention, center line average roughness (Ra) is measured according to the JIS surface roughness (B0601), using a surface roughness measuring device (SURFCORDER SE-30H; manufactured by KOSAKA LABORATORY K.K.). The center line average roughness (Ra) specifically refers to the following value: As shown in FIG. 4, the part corresponding to a measured length Q (2.5 mm) is extracted from a roughness curve in the direction of its center line. The center line of this extracted part is regarded as X axis, and the direction of longitudinal magnification as Y axis. The roughness curve is represented by y=f(x). Then, a value obtained by the following equation is expressed in micrometer (μm), which is the center line average roughness (Ra).

$$Ra=\frac{1}{l}\int_0^l |f(x)|dx$$

Figure 5:
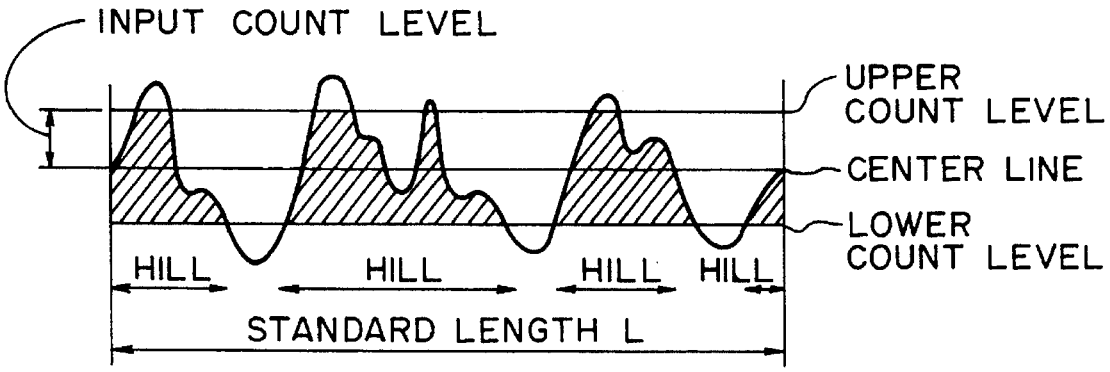
FIG. 5 is an illustration concerning the mean space (Sm) between concavities and convexities on the surface of a developer carrying member.

In the present invention, the mean space (Sm) is obtained by the equation: Sm=L/n, wherein L represent a standard length and is 2.5 mm, and n represents the number of hills. The number of hills n is determined in the following way: As shown in FIG. 5, two lines parallel to the center line of the roughness curve are provided respectively as upper and lower peak-count levels (±0.21 μm). When the point at which the upper peak-count level and the roughness curve intersect to each other is present at least once between the two points at which the lower peak-count level and the roughness curve intersect to each other, this is regarded as a hill and the number of hills n is determined within the range of the standard length L (2.5 mm).

In order to promote release of a developer from the surface of the developer carrying member, a material with a low surface energy may be added.

Such a material includes, for example, fluorine compounds, boron nitride, and graphite.

Figure 2:
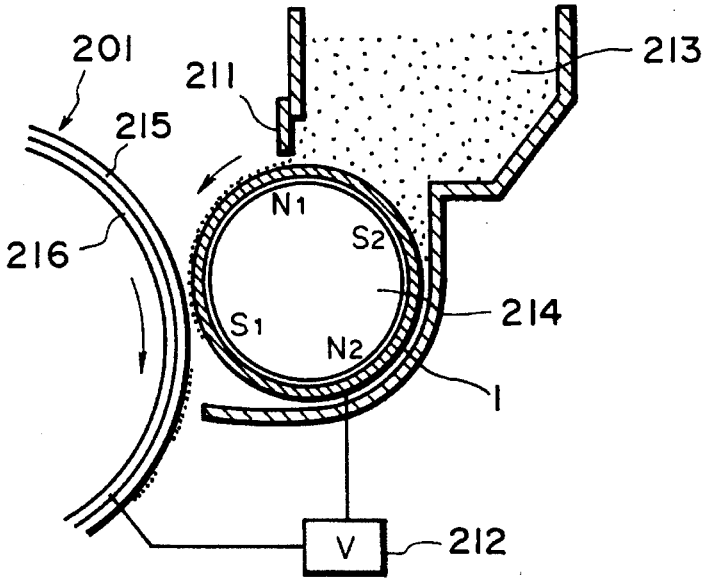
FIG. 2 schematically illustrates an example of the developing device of the present invention.
Figure 3:
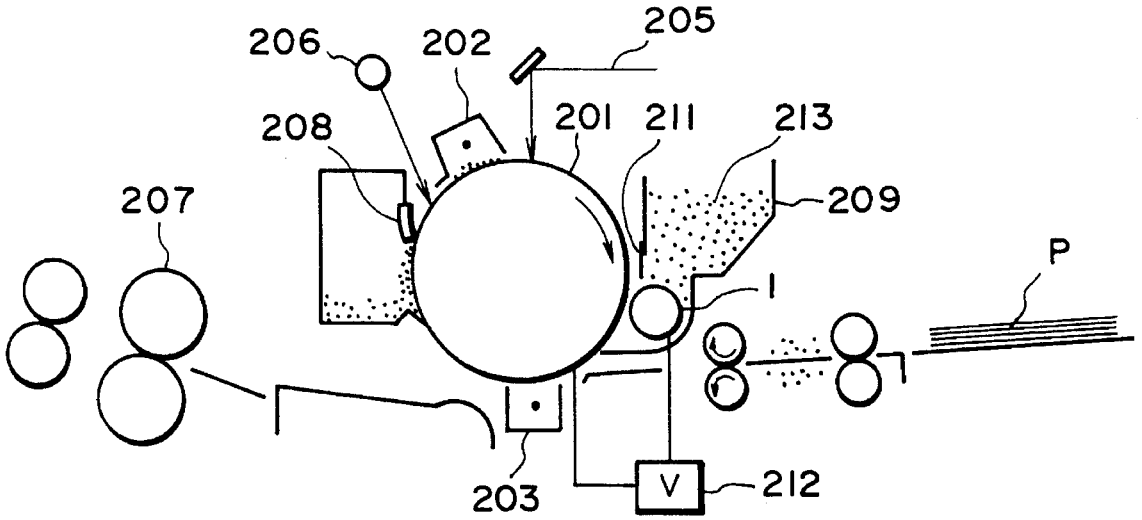
FIG. 3 schematically illustrates an example of an image forming apparatus in which the developing device of the present invention is employed.

The developing device of the present invention, used in an electrophotographic apparatus will be described with reference to FIGS. 2 and 3. The surface of a photosensitive member is negatively or positively charged by the operation of a primary charger 202, and a digital latent image is formed by image scanning through exposure 205 using a laser beam (or an analog latent image is formed through reflection exposure 205 of an original). The latent image thus formed is developed using a one-component magnetic developer 213 held in a developing assembly 209 equipped with a developer carrying member 1 in which a magnetic blade 211 and a magnet 214 are provided. In the developing zone, a development bias comprised of an AC bias, a pulse bias and/or a DC bias is/are applied between a conductive substrate 216 of a photosensitive drum 201 and the developer carrying member 1 through a bias applying means 212. A transfer paper P is fed and delivered to a transfer zone, where the transfer paper P is electrostatically charged in a positive polarity or negative polarity from its back surface (the surface opposite to the photosensitive drum) through a transfer charger 203, so that the negatively charged toner image or positively charged toner image on the surface of the photosensitive drum is electrostatically transferred to the transfer paper P. The transfer paper P Separated from the photosensitive drum 201 is subjected to fixing using a heat-pressure roller fixing assembly 207 so that the toner image on the transfer paper can be fixed.

The one-component developer remaining on the photosensitive drum 201 after the transfer step is removed by the operation of a cleaning assembly 208 having a cleaning blade. After the cleaning, the residual charges on the photosensitive drum 201 is eliminated by erasure exposure 206, and thus the procedure starting from the charging step using the primary charger 202 is repeated again.

An electrostatic image supporting member (the photosensitive drum) comprises a photosensitive layer 215 and a conductive substrate 216, and is rotated in the direction of an arrow. In the developing zone, the non-magnetic, cylindrical developer carrying member 1 is rotated so as to move in the same direction as the direction in which the electrostatic image supporting member is rotated. In the inside of the developer carrying member 1, a multi-polar permanent magnet (magnet roll) 214 serving as a magnetic field generating means is provided in a nonrotatable state. The one-component insulating magnetic developer 213 held in the developing assembly 209 is coated on the surface of the developer carrying member 1, and triboelectric charges are imparted to toner particles because of the friction between the surface of the developer carrying member 1 and the toner particles. A magnetic doctor blade 211 made of iron is disposed opposingly to one of the magnetic pole positions of the multi-polar permanent magnet, in proximity (with a space of from 50 μm to 500 μm) to the surface of the developer carrying member 1. Thus, the thickness of a toner layer can be controlled to be small (from 30 μm to 300 μm) and uniform so that a developer layer smaller in thickness than the gap between the photosensitive drum 201 and developer carrying member 1 in the developing zone can be formed in a non-contact state. The rotational speed of the developer carrying member 1 is regulated so that the peripheral speed of the developer carrying member 1 can be substantially equal or close to the peripheral speed of the electrostatic image supporting surface. As the magnetic doctor blade 211, a permanent magnet may be used in place of iron to form an opposing magnetic pole. In the developing zone, the AC bias or pulse bias may be applied through the bias means 212, between the developer carrying member 1 and the electrostatic image supporting surface. This AC bias may have a frequency of from 200 to 4,000 Hz, and a Vpp of from 500 to 3,000 V.

When the toner particles are moved in the developing zone, the toner particles are moved to the side of a latent image by the electrostatic force of the electrostatic charge retaining surface and the action of the AC bias or pulse bias.

In place of the magnetic doctor blade 211, an elastic blade formed of an elastic material such as silicone rubber may be used so that the layer thickness of the developer layer can be controlled by pressure and thereby the toner can be coated on the developer carrying member 1.

The electrophotographic apparatus may be constituted of a combination of plural components integrally joined as one apparatus unit from among the constituents such as the above photosensitive member, developing means end cleaning means so that the unit can be freely mounted on or detached from the body of the apparatus. For example, at least one of the charging means, developing means and cleaning means may be integrally supported together with the photosensitive member to form one unit that can be freely mounted on or detached from the body of the apparatus, and the unit can be freely mounted or detached using a guide means such as a rail provided in the body of the apparatus. Here, the above apparatus unit may be so constituted as to be joined together with the charging means and/or the developing means.

The present invention will be described in greater detail by giving preparation examples and working examples. In the following, "part(s)" refers to "part(s) by weight" in all occurrences.

PREPARATION EXAMPLE 1

| | |
|---|---|
| Graphite (UFG-10, available from Showa Denko K.K.; degree of graphitization: 100%; major axis diameter: 5μ; thickness: 0.5μ or less) | 100 parts |
| Resol type phenol resin | 100 parts |
| Spherical resol type phenol resin particles subjected to hardening treatment (positively chargeable; average particle diameter: 2μ) | 4 parts |

The above materials for a coating film were added to 75 parts of butyl alcohol, and mixed. Thereafter, the mixture was dispersed for 10 hours using a ball mill holding therein balls of 200μ in diameter as medium particles. After dispersion was completed, the balls were separated using a sieve of 64 meshes to give an undiluted solution (solid content: 24 wt. %). This solution is designated as undiluted Solution 1.

PREPARATION EXAMPLE 2

| | |
|---|---|
| Graphite (UFG-10, available from Showa Denko K.K.; major axis diameter: 5 μ) | 100 parts |
| Epoxy resin | 100 parts |
| Spherical alumina particles (positively chargeable; number average particle diameter: 0.1μ; degree of sphericity: 1.0) | 5 parts |

The above materials were added to 75 parts of n-propyl alcohol, and mixed. Thereafter, the mixture was dispersed using a sand mill filled with steel balls of 1 mm in diameter. After dispersion was completed, the steel balls were separated to give an undiluted solution (solid content: 25 wt. %). This stock solution is designated as Undiluted Solution 2.

PREPARATION EXAMPLE 3

| | |
|---|---|
| Graphite (available from Nihon Kokuen K.K.; major axis diameter: 80μ) | 70 parts |
| Carbon black (Conductex 900, available from Columbia Kagaku K.K.; oil absorption: 120 cc/100 g) | 30 parts |
| Resol type phenol resin | 100 parts |
| Spherical resol type phenol resin particles subjected to hardening treatment (positively chargeable; average particle diameter: 4μ) | 4 parts |

The above materials were treated in the same manner as in Example 1 to give a undiluted solution (solid content: 24 wt. %). This solution is designated as Undiluted Solution 3.

EXAMPLE 1

To Undiluted Solution 1, 20 parts of butyl alcohol was added to give a coating solution (solid content: 20 wt. %). Using this coating solution, a coating was formed on a carrying member substrate made of aluminum (an aluminum cylinder) of 20 mm in diameter by dip coating. Next, using a hot-air drying oven, the coating was cured by heating at 150° C. for 30 minutes. A developer carrying member was thus prepared.

The coating film thus formed on the aluminum substrate had a surface roughness (Ra) of 2.5μ. Using a modified NP-5540 (a copying machine manufactured by Canon Inc.) in which a developing sleeve was replaced with this developer carrying member and a photosensitive member was replaced with an α-Si photosensitive member so as to be suited for a negatively chargeable one-component magnetic developer, 10,000 sheets paper-feed tests were carried out in environments of a temperature of 10° C. and a humidity of 10% RH and of a temperature of 30° C. and a humidity of 80% RH, respectively. Evaluation was made according to the following evaluation items.

The above negatively chargeable one component magnetic developer was comprised of 100 parts by weight of a negatively chargeable magnetic toner with a number average particle diameter of 11 μm, prepared from the following materials, and 0.5 part by weight of negatively chargeable hydrophobic colloidal silica.

| | |
|---|---|
| Polyester resin | 100 parts |
| Magnetic material | 60 parts |
| Negative charge controlling agent | 2 parts |
| Low-molecular polypropylene | 3 parts |

In the above copying machine, the gap between the surface of the developer carrying member (a developing sleeve) and a magnetic blade was set to be 250 μm, the developer layer (a magnetic toner layer) on the developer carrying member was made to be about 120 μm thick, and the closest gap between the surface of the developer carrying member and the surface of the α-Si photosensitive member was set to be about 300 μm. A developing bias comprised of a DC bias +400 V and an AC bias ($V_{pp}$: 1,200 V; 1,800 Hz) was also applied to the developer carrying member.

Evaluation Items (1) Image Density: (Macbeth Reflection Density)

AA: Over 1.4

A: Over 1.2 to 1.4

B: Over 1.0 to 1.2

C: 1.0 or less (2) Image Quality: (Visually Observed on Coarse Image, Thin-Line Reproducibility, Black Spots around Line Image, Fog, Etc.)

AA: Excellent

A: Good

B: Practically usable

C: Practically unusable in Preparation Example 1. Evaluation was also made in the same way. Results obtained are shown in Table 1.

In Comparative Example 2, there are no problems on both the density and image quality at the initial stage. On the other hand, in the course of the duration of copying, an irregular coat (blotchy image) was seen to occur in a low-temperature and low-humidity environment (L/L).

TABLE 1

| | Surface roughness | Low temp. low humidity (L/L) | | | | High temp. high humidity (H/H) | | | |
|---|---|---|---|---|---|---|---|---|---|
| | | Initial stage | | After 10,000 sheet duration | | Initial stage | | After 10,000 sheet duration | |
| | Ra (μ) | ID. | IQ. | ID. | IQ. | ID. | IQ. | ID. | IQ. |
| Example: | | | | | | | | | |
| 1 | 2.5 | AA | A | A | A | A | A | AA | A |
| Reference Example | | | | | | | | | |
| 2 | 2.5 | A | A | A | A | A | A | A | A |
| Comparative Example: | | | | | | | | | |
| 1 | 2.0 | B | B* | C | C* | B | A | B | C |
| 2 | 2.5 | AA | A | B | C** | A | A | A | C** |

ID.: Image density
IQ.: Image quality
*Black dots around line image, ghost
**Blotchy image Results obtained are shown in Table 1.

As will be evident from Table 1, in the developing device that employs the developer carrying member of the present invention, there is no problem on image quality, image density is stable, and no deterioration occurs after duration of copying.

REFERENCE EXAMPLE 2

A developer carrying member was prepared in the same manner as in Example 1, except that Undiluted Solution 2 was applied by spray coating as it was, and the coating was cured with ultraviolet rays. Evaluation was also made in the same way. Results obtained are shown in Table 1.

COMPARATIVE EXAMPLE 1

The surface was toughened using sand blast so that the surface of an aluminum substrate of 20 mm in diameter was provided with substantially the same surface roughness (Ra=2.5μ). The resulting carrying member made of aluminum was evaluated in the same manner as in Example 1. Results obtained are shown in Table 1.

In Comparative Example 1, image density becomes low in a low-temperature and low-humidity environment, and black spots around line image and developer carrying member memory tend to occur.

COMPARATIVE EXAMPLE 2

A developer carrying member was prepared in the same manner as in Example 1, except that the spherical resol type phenol resin particles were excluded from the materials used Providing the coating film on the surface of the developer carrying member has made stable both the image density and image quality.

Adding the spherical particles in the coating film is seen to cause less change as a result of the duration of copying.

EXAMPLE 3

A coating solution was prepared in the same way except that among the materials in Preparation Example 1 the particle diameter of the phenol resin particles was changed to 20μ. Coating was carried out in the same manner as in Example 1 to prepare a developer carrying member. Evaluation was also made similarly.

Results obtained are shown in Table 2.

REFERENCE EXAMPLE 4

A coating solution was prepared in the same way except that among the materials in Preparation Example 2 the particle diameter of the spherical alumina particles was changed to 0.05μ. Coating was carried out in the same manner as in Example 2 to prepare a developer carrying member. Evaluation was also made similarly.

Results obtained are shown in Table 2.

COMPARATIVE EXAMPLE 3

A coating solution was prepared in the same way except that among the materials in Preparation Example 1 the number average particle diameter of the phenol resin particles was changed to 40μ. Coating was carried out in the same manner as in Example 1 to prepare a developer carrying member. Evaluation was also made similarly.

Results obtained are shown in Table 2.

COMPARATIVE EXAMPLE 4

A coating solution was prepared in the same way except that among the materials in Preparation Example 2 the particle diameter of the spherical alumina particles was changed to 0.02μ. Coating was carried out in the same manner as in Example 2 to prepare a developer carrying member. Evaluation was also made similarly.

Results obtained are shown in Table 2.

TABLE 2

| | Surface roughness | Low temp. low humidity (L/L) | | | | High temp. high humidity (H/H) | | | |
|---|---|---|---|---|---|---|---|---|---|
| | | Initial stage | | After 10,000 sheet duration | | Initial stage | | After 10,000 sheet duration | |
| | Ra (μ) | ID. | IQ. | ID. | IQ. | ID. | IQ. | ID. | IQ. |
| Example: | | | | | | | | | |
| 3 | 3.0 | A | A | A | A | A | B | A | A |
| Reference Example | | | | | | | | | |
| 4 | 2.0 | A | A | A | B | A | A | A | A |
| Comparative Example: | | | | | | | | | |
| 3 | 6.0 | B | C* | B | C* | C | C* | B | C* |
| 4 | 2.5 | A | A | B | C** | B | A | A | C** |

ID.: Image density
IQ.: Image quality
*Thin-line reproducibility was lowered.
**Agglomerates of the developer partially appeared on the developer carrying member to cause difference in density of the toner image. Blotchy image.

It is seen that the particle diameter of the spherical material is preferably in the range of from 0.05 to 30μ.

EXAMPLE 5

To Undiluted Solution 3, 60 parts of butyl alcohol was added to give a coating solution (solid content: 15 wt. %). This coating solution was applied to an aluminum substrate in the same manner as in Example 1, followed by heat curing. A developer carrying member was thus prepared. Evaluation was also made similarly. Results obtained are shown in Table 3.

EXAMPLE 6

A coating solution was prepared in the same way except that among the materials in Preparation Example 3 the graphite and the carbon black were each added in an amount of 50 parts. Coating was carried out in the same manner as in Example 1 to prepare a developer carrying member. Evaluation was also made similarly.

Results obtained are shown in Table 3.

EXAMPLE 7

A coating solution was prepared in the same way except that among the materials in Preparation Example 1 the Graphite was added in an amount of 25 parts and the phenol resin in an amount of 75 parts. Coating was carried out in the same manner as in Example 1 to prepare a developer carrying member. Evaluation was also made similarly.

Results obtained are shown in Table 3.

EXAMPLE 8

A coating solution was prepared in the same way except that among the materials in Preparation Example 1 the graphite was added in an amount of 67 parts and the phenol resin in an amount of 33 parts. Coating was carried out in the same manner as in Example 1 to prepare a developer carrying member. Evaluation was also made similarly.

Results obtained are shown in Table 3.

EXAMPLE 9

A coating solution was prepared in the same way except that among the materials in Preparation Example 1 the phenol resin was added in an amount of 6 parts. Coating was carried out in the same manner as in Example 1 to prepare a developer carrying member. Evaluation was also made similarly.

Results obtained are shown in Table 3.

EXAMPLE 10

A coating solution was prepared in the same way except that among the materials in Preparation Example 1 the spherical phenol resin particles were used in an amount of 0.2 part. Coating was carried out in the same manner as in Example 1 to prepare a developer carrying member. Evaluation was also made similarly.

Results obtained are shown in Table 3.

EXAMPLE 11

A coating solution was prepared in the same way except that among the materials in Preparation Example 1 the spherical phenol resin particles were replaced with spherical polytetrafluoroethylene resin (PTFE) particles (negatively chargeable). Coating was carried out in the same manner as in Example 1 to prepare a developer carrying member. Evaluation was also made similarly.

Results obtained are shown in Table 3.

TABLE 3

| | Surface roughness | Low temp. low humidity (L/L) | | | | High temp. high humidity (H/H) | | | |
|---|---|---|---|---|---|---|---|---|---|
| | | Initial stage | | After 10,000 sheet duration | | Initial stage | | After 10,000 sheet duration | |
| | Ra (μ) | ID. | IQ. | ID. | IQ. | ID. | IQ. | ID. | IQ. |
| Example: | | | | | | | | | |
| 5 | 2.5 | AA | A | AA | A | AA | A | AA | A |
| 6 | 2.5 | AA | A | AA | B* | AA | A | AA | A |
| 7 | 2.0 | A | A | B | B* | A | A | AA | A |
| 8 | 3.0 | AA | A | A | B** | AA | A | A | A |
| 9 | 3.5 | A | A | A | A | B | A | A | A |
| 10 | 2.0 | A | A | B | B** | A | A | A | A |
| 11 | 2.5 | A | A | A | A | B | B | A | B |

ID.: Image density
IQ.: Image quality
*Ghost
**Uneven image

EXAMPLE 12

| | |
|---|---|
| Carbon black (Conductex 900, available from Columbia Kagaku K.K.; oil absorption: 120 cc/100 g; a = 0.96) | 80 parts |
| Resol type phenol resin (a binder resin) | 100 parts |
| Spherical resol type phenol resin particles subjected to hardening treatment (number average particle diameter: 2μ) | 10 parts |

The above materials for a coating film were added to butyl alcohol so as to be 30 wt. % as solid content. Using a sand mill filled with steel ball of 1 mm in diameter, the mixture obtained was passed through it three times to carry out dispersion. In the resulting coating material for a coating film, a carrying member substrate of 20 mm in diameter, made of aluminum, was dipped to carry out dip coating. A coating of 10 μm thus formed was heated using a hot-air drying oven for at 150° C. for 30 minutes to effect curing. The surface of the coating film thus formed on the resulting developer carrying member had an Sm of 40 μm and an Ra of 2.2 μm.

Using a modified NP-5540 (a copying machine manufactured by Canon Inc.) in which a developing sleeve was replaced with this developer carrying member and a photosensitive member was replaced with an α-Si photosensitive member so as to be suited for a negative toner, 10,000 sheets paper-feed tests were carried out in environments of 10° C., 10% RH and of 30° C., 80% RH, respectively. Evaluation was made in the same manner as in Example 1. Results obtained are shown in Table 4.

EXAMPLE 13

A developer carrying member was prepared in the same manner as in Example 12, except that an epoxy resin was used as a binder resin, methyl ethyl ketone was used as a solvent, and the coating formed was cured by adding an amine and heating at 150° C. for 1 hour. Images were produced in the same manner as in Example 12. Results obtained are shown in Table 4.

EXAMPLE 14

A developer carrying member was prepared in the same manner as in Example 12, except that a styrene/butadiene copolymer was used as a binder resin, methyl ethyl ketone was used as a solvent, and the coating formed was cured at 80° C. for 20 minutes. Images were produced in the same manner as in Example 12. Results obtained are shown in Table 4.

COMPARATIVE EXAMPLE 5

A developer carrying member was prepared in the same manner as in Example 12, except that the developer carrying member was replaced with a developing sleeve made of aluminum and, in place of providing the coating film, blasting was applied to the surface of the aluminum cylinder so as to give the same surface roughness. Images were produced in the same manner as in Example 12. Results obtained are shown in Table 4.

COMPARATIVE EXAMPLE 6

A developer carrying member was prepared in the same manner as in Example 12, except that the spherical material was not used. Images were produced in the same manner as in Example 12. Results obtained are shown in Table 4.

TABLE 4

| | Coating film surface | | Temp.: 10° C. Humidity: 10% RH | | | | Temp: 30° C. Humidity: 80% RH | | | |
|---|---|---|---|---|---|---|---|---|---|---|
| | | | Initial stage | | After 10,000 sheet duration | | Initial stage | | After 10,000 sheet duration | |
| | Ra | Sm | ID. | IQ. | ID. | IQ. | ID. | IQ. | ID. | IQ. |
| Example: | | | | | | | | | | |
| 12 | 2.5 | 40 | AA | AA | A | AA | A | AA | AA | AA |
| 13 | 2.0 | 30 | A | A | A | AA | A | A | A | AA |
| 14 | 2.0 | 30 | AA | A | B | B | A | A | B | B |
| Comparative Example: | | | | | | | | | | |
| 5 | 2.0 | 20 | A | B | C | C | B | A | B | C |
| 6 | 0.2 | 120 | A | C | B | C | A | A | A | C |

ID.: Image density
IQ.: Image quality

Remarks

In Example 14, the coating film was partially damaged.

In Comparative Example 5, ghosts occurred.

In Comparative Example 6, blotchy images occurred.

It is seen from the above results that both the image density and the image quality can be stabilized when the particular coating film is provided on the surface of the developer carrying member.

It is also seen that changes due to the duration of copying on a large number of sheets can be decreased when the spherical particles are added in the coating film.

It is further seen that there is a difference depending on the type of the binder resin and thus the thermosetting resin has a superiority.

EXAMPLE 15

A developer carrying member was prepared in the same manner as in Example 12, except that spherical phenol resin particles with a number average particle diameter of 15 μm were added in an amount of parts. Images were produced in the same manner as in Example 12. Results obtained are shown in Table 5.

EXAMPLE 16

A developer carrying member was prepared in the same manner as in Example 12, except that spherical phenol resin particles with a number average particle diameter of 0.1 μm were added in an amount of 3 parts. Images were produced in the same manner as in Example 12. Results obtained are shown in Table 5.

COMPARATIVE EXAMPLE 7

A developer carrying member was prepared in the same manner as in Example 12, except that spherical phenol resin particles with a number average particle diameter of 35 μm were added in an amount of 20 parts. Images were produced in the same manner as in Example 12. Results obtained are shown in Table 5.

COMPARATIVE EXAMPLE 8

A developer carrying member was prepared in the same manner as in Example 12, except that spherical phenol resin particles with a number average particle diameter of 0.02 μm were added in an amount of 10 parts. Images were produced in the same manner as in Example 12. Results obtained are shown in Table 5.

TABLE 5

| | Coating film surface | | Temp.: 10° C. Humidity: 10% RH | | | | Temp: 30° C. Humidity: 80% RH | | | |
|---|---|---|---|---|---|---|---|---|---|---|
| | | | Initial stage | | After 10,000 sheet duration | | Initial stage | | After 10,000 sheet duration | |
| | Ra | Sm | ID. | IQ. | ID. | IQ. | ID. | IQ. | ID. | IQ. |
| Example: | | | | | | | | | | |
| 15 | 2.5 | 70 | AA | AA | AA | A | A | A | A | A |
| 16 | 0.4 | 2 | AA | A | A | B | AA | AA | AA | AA |
| Comparative Example: | | | | | | | | | | |

TABLE 5-continued

| | Coating film surface | | Temp.: 10° C. Humidity: 10% RH | | | | Temp: 30° C. Humidity: 80% RH | | | |
|---|---|---|---|---|---|---|---|---|---|---|
| | | | Initial stage | | After 10,000 sheet duration | | Initial stage | | After 10,000 sheet duration | |
| | Ra | Sm | ID. | IQ. | ID. | IQ. | ID. | IQ. | ID. | IQ. |
| 7 | 6.0 | 90 | A | C | A | C | C | A | B | A |
| 8 | 0.2 | 0.8 | A | C | B | C | A | A | A | B |

ID.: Image density
IQ.: Image quality

Remarks

In Comparative Example 7, a coarse image and black spots around line image occurred.

In Comparative Example 8, ghosts and blotchy images occurred.

It is seen from the above results that good results can be obtained when the particle diameter of the spherical particles added is in the range of from 0.05 to 30 μm.

It is also seen that good results can be obtained when the surface of the coating film is in the state of Ra=0.3 to 3.0 μm and Sm=1 to 100 μm (Sm/d=0.1 to 10 in the case when the toner in the developer has a particle diameter of 10 μm).

EXAMPLE 17

A developer carrying member was prepared in the same manner as in Example 12, except that the carbon black was added in an amount of 25 parts (a=0.3). Images were produced in the same manner as in Example 12. Results obtained are shown in Table 6.

EXAMPLE 18

A developer carrying member was prepared in the same manner as in Example 12, except that the carbon black was added in an amount of 250 parts (a= 3.0). Images were produced in the same manner as in Example 12. Results obtained are shown in Table 6.

EXAMPLE 19

A developer carrying member was prepared in the same manner as in Example 12, except that the spherical particles were replaced with spherical highly cross-linked polymethyl methacrylate particles (average particle diameter: 2 μm). Images were produced in the same manner as in Example 12. Results obtained are shown in Table 6.

EXAMPLE 20

A developer carrying member was prepared in the same manner as in Example 12, except that the spherical particles were replaced with spherical polyethylene resin particles (average particle diameter: 2 μm). Images were produced in the same manner as in Example 12. Results obtained are shown in Table 6.

TABLE 6

| | Coating film surface | | Temp.: 10° C. Humidity: 10% RH | | | | Temp: 30° C. Humidity: 80% RH | | | |
|---|---|---|---|---|---|---|---|---|---|---|
| | | | Initial stage | | After 10,000 sheet duration | | Initial stage | | After 10,000 sheet duration | |
| | Ra | Sm | ID. | IQ. | ID. | IQ. | ID. | IQ. | ID. | IQ. |
| Example: | | | | | | | | | | |
| 17 | 1.6 | 50 | AA | A | A | B | AA | AA | AA | A |
| 18 | 2.6 | 30 | AA | AA | A | B | A | A | B | A |
| 19 | 2.0 | 45 | AA | A | A | A | A | AA | A | AA |
| 20 | 2.4 | 30 | A | A | A | A | A | A | A | A |

ID.: Image density
IQ.: Image quality

It is seen from the foregoing results that the state of the coating film surface also changes depending on the amount of the addition of carbon black, but it is more changed by spherical particles.

It is also seen that the film quality can be stable to bring about stable images when the binder resin is used to give the coefficient a ranging from 0.3 to 3.0, and preferably from 0.5 to 2, with respect to the oil absorption of carbon black.

As described above, the developer carrying member of the present invention makes it possible to obtain copies having good durability and high image quality.

I claim:

1. A developer carrying member comprising a substrate and a coating film, wherein the surface of said substrate is covered with said coating film, and said coating film is formed by coating with a coating solution containing (a) separately dispersed therein (i) a graphite, a carbon black or a mixture thereof, and (ii) a spherical resin particle having a number average particle diameter of from 0.05 to 30μ and the ratio of major axis to minor axis of said spherical resin particle is from 1.0 to 1.5, and (b) a film-forming binder resin dissolved in said coating solution, said spherical resin particle providing a surface of said coating film with roughness.

2. A developer carrying member according to claim 1, wherein said substrate is formed of a cylinder made of a metal, and said coating film comprises a thermosetting binder resin, a positively chargeable spherical resin particle and a graphite.

3. A developer carrying member according to claim 1, wherein said substrate is formed of a cylinder made of a metal, and said coating film comprises a thermosetting binder resin, a positively chargeable spherical resin particle and a carbon black.

4. A developer carrying member according to claim 1, wherein said substrate is formed of a cylinder made of a conductive metal, and said coating film comprises a thermosetting binder resin, a positively chargeable spherical resin particle, a graphite and a carbon black.

5. A developer carrying member according to claim 1, wherein said coating film comprises a thermosetting phenol resin, a spherical phenol resin particle and a graphite.

6. A developer carrying member according to claim 1, wherein said coating film comprises a thermosetting phenol resin, a spherical phenol resin particle and a carbon black.

7. A developer carrying member according to claim 1, wherein said coating film comprises a thermosetting phenol resin, a spherical phenol resin particle, a graphite and a carbon black.

8. A developer carrying member according to claim 1, wherein said coating film has a center line surface roughness (Ra) of from 0.2 to 5.0 μm.

9. A developer carrying member according to claim 1, wherein said coating film has a center line surface roughness (Ra) of from 0.3 to 3 μm.

10. A developer carrying member according to claim 1, wherein said coating film has a center line surface roughness (Ra) of from 0.5 to 3 μm.

11. A developer carrying member according to claim 1, wherein said spherical resin particle is contained in an amount of from 1 to 20 wt. % based on the weight of said binder resin.

12. A developer carrying member according to claim 1, wherein said graphite is contained in the range of from 2/1 to 1/3 in weight ratio of the graphite to the binder resin.

13. A developer carrying member according to claim 1, wherein said carbon black has an electrical resistivity of not more than 0.5 Ω·cm after it has been molded at a pressure of 120 kg/cm$^2$.

14. A developer carrying member according to claim 1, wherein said carbon black is added in an amount of W parts by weight, satisfying the following equation, based on 100 parts by weight of said binder resin:

W=[{100/(oil absorption of carbon black)}×100]×a wherein the oil absorption of carbon black refers to an oil absorption of dibutyl phthalate to 100 g of carbon black [cc/100 g], according to ASTM No. D-2414-79; and the coefficient a represents 0.3 to 3.

15. A developing device for developing an electrostatic image comprising a developer carrying member for carrying and feeding a developer and a developer layer thickness control member for controlling a layer thickness of the developer carried on the developer carrying member, said developer carrying member comprising a substrate and a coating film, wherein the surface of said substrate is covered with said coating film, and said coating film is formed by coating with a coating solution containing (a) separately dispersed therein (i) a graphite, a carbon black or a mixture thereof, and (ii) a spherical resin particle having a number average particle diameter of from 0.05 to 30μ and the ratio of major axis to minor axis of said spherical resin particle is from 1.0 to 1.5, and (b) a film-forming binder resin dissolved in said coating solution, said spherical resin particle providing a surface of said coating film with roughness.

16. A developing device according to claim 15, wherein said substrate is formed of a cylinder made of a metal, and said coating film comprises a thermosetting binder resin, a positively chargeable spherical resin particle and a carbon black.

17. A developing device according to claim 15, wherein said substrate is formed of a cylinder made of a conductive metal, and said coating film comprises a thermosetting binder resin, a positively chargeable spherical resin particle, a graphite and a carbon black.

18. A developing device according to claim 15, wherein said coating film comprises a thermosetting phenol resin, a spherical phenol resin particle and a graphite.

19. A developing device according to claim 15, wherein said coating film comprises a thermosetting phenol resin, a spherical phenol resin particle and a carbon black.

20. A developing device according to claim 15, wherein said coating film comprises a thermosetting phenol resin, a spherical phenol resin particle, a graphite and a carbon black.

21. A developing device according to claim 15, wherein said coating film has a center line surface roughness (Ra) of from 0.2 to 5.0 μm.

22. A developing device according to claim 15, wherein said coating film has a center line surface roughness (Ra) of from 0.3 to 3 μm.

23. A developing device according to claim 15, wherein said coating film has a center line surface roughness (Ra) of from 0.5 to 3 μm.

24. A developing device according to claim 15, wherein said spherical resin particle is contained in an amount of from 1 to 20 wt. % based on the weight of said binder resin.

25. A developing device according to claim 15, wherein said graphite is contained in the range of from 2/1 to 1/3 in weight ratio of the graphite to the binder resin.

26. A developing device according to claim 15, wherein said carbon black has an electrical resistivity of not more than 0.5 Ω·cm after it has been molded at pressure of 120 kg/cm$^2$.

27. A developing device according to claim 15, wherein said carbon black is added in an amount of W parts by weight, satisfying the following equation, based on 100 parts by weight of said binder resin:

W=[{100/(oil absorption of carbon black)}×100]×a wherein the oil absorption of carbon black refers to an oil absorption of dibutyl phthalate to 100 g of carbon black [cc/100 g], according to ASTM No. D-2414-79; and the coefficient a represents 0.3 to 3.

28. A developing device according to claim 15, wherein said developer carrying member has a means for applying a developing bias.

29. A developing device according to claim 15, wherein said developer carrying member has a one-component type magnetic developer comprising a magnetic toner, 30. A developing device according to claim 15, wherein said developer carrying member has a one-component type magnetic developer comprising a negatively chargeable magnetic toner.

31. A developing device according to claim 15, wherein the coating film of said developer carrying member has a mean space Sm between irregularities on its surface, satisfying the following equation:

$$Sm/d = 1/10 \text{ to } 10$$

wherein d represents an average particle diameter of the magnetic toner supported on said developer carrying member.

32. A device unit comprising a developing means and a photosensitive member which are integrally held to form a unit that gives a single unit capable of being freely mounted on and detached from an apparatus main body, said developing means comprising a developer carrying member, and said developer carrying member comprising a substrate and a coating film, wherein the surface of said substrate is covered with said coating film, and said coating film is formed by coating with a coating solution containing (a) separately dispersed therein (i) a graphite, a carbon black or a mixture thereof, and (ii) a spherical resin particle having a number average particle diameter of from 0.05 to 30μ and the ratio of major axis to minor axis of said spherical resin particle is from 1.0 to 1.5, and (b) a film-forming binder resin dissolved in said coating solution, said spherical resin particle providing a surface of said coating film with roughness.

33. A developer carrying member according to claim 1, wherein said spherical resin particle is formed of a material selected from the group consisting of a phenol resin, a methyl methacrylate resin, a styrene/butadiene copolymer and a nitrogen-containing resin.

34. A developer carrying member according to claim 1, wherein said binder resin is formed of a thermosetting resin.

35. A developer carrying member according to claim 34, wherein said thermosetting resin comprises a thermosetting phenol resin or a thermosetting epoxy resin.

36. A developing device according to claim 15, wherein said spherical resin particle is formed of a material selected from the group consisting of a phenol resin, a methyl methacrylate resin, a styrene/butadiene copolymer and a nitrogen-containing resin.

37. A developing device according to claim 15, wherein said binder resin is formed of a thermosetting resin.

38. A developing device according to claim 37, wherein said thermosetting resin comprises a thermosetting phenol resin or a thermosetting epoxy resin.

39. A device unit according to claim 32, wherein said substrate is formed of a metallic cylinder and said coating film comprises a thermosetting binder resin, a positively chargeable spherical resin particle and a graphite.

40. A device unit according to claim 32, wherein said substrate is formed of a metallic cylinder and said coating film comprises a thermosetting binder resin, a positively chargeable spherical resin particle and a carbon black.

41. A device unit according to claim 32, wherein said substrate is formed of a conductive metal and said coating film comprises a thermosetting binder resin, a positively chargeable spherical resin particle and a carbon black.

42. A device unit according to claim 32, wherein said coating film comprises a thermosetting phenol resin, a spherical phenol resin particle and a graphite.

43. A device unit according to claim 32, wherein said coating film comprises a thermosetting phenol resin, a spherical phenol resin particle and a carbon black.

44. A device unit according to claim 32, wherein said coating film comprises a thermosetting phenol resin, a spherical phenol resin, a graphite and a carbon black.

45. A device unit according to claim 32, wherein said coating film has a center line surface roughness (Ra) of from 0.2 to 5.0 μm.

46. A device unit according to claim 32, wherein said coating film has a center line surface roughness (Ra) of from 0.3 to 3 μm.

47. A device unit according to claim 32, wherein said coating film has a center line surface roughness (Ra) of from 0.5 to 3 μm.

48. A device unit according to claim 32, wherein said spherical resin particle is formed in an amount of from 1 to 20 wt. % based on the weight of said binder resin.

49. A device unit according to claim 32, wherein said graphite is contained in the range of from 2/1 to 1/3 in a weight ratio of the graphite to the binder resin.

50. A device unit according to claim 32, wherein said carbon black has an electrical resistivity of not more than 0.5 Ωcm after it has been molded at a pressure of 120 kg/cm$^2$.

51. A device unit according to claim 32, wherein said carbon black is added in an amount of W parts by weight, satisfying the following equation, based on 100 parts by weight of said binder resin:

$$W=[(100/(\text{oil absorption of carbon black}))\times 100]\times a$$

wherein the oil absorption of carbon black refers to an oil absorption of dibutyl phthalate to 100 g of carbon black [cc/100 g], according to ASTM No. D-2414-79; and the coefficient a is from 0.3 to 3.

52. A device unit according to claim 32, wherein said spherical resin particle is formed of a material selected from the group consisting of a phenol resin, a methyl methacrylate resin, a styrene/butadiene copolymer and a nitrogen-containing resin.

53. A device unit according to claim 32, wherein said binder resin is formed of a thermosetting resin.

54. A device unit according to claim 32, wherein said thermosetting resin comprises a thermosetting phenol resin or a thermosetting epoxy resin.

55. A developing device according to claim 15, wherein the developer carrying member rotates to feed the developer to a developing zone.

56. A developing device according to claim 55, wherein the developer is a one-component developer.

57. A developing device according to claim 56, where the one-component developer is triboelectrically charged due to friction with the developer carrying member.

58. A device unit according to claim 32, wherein the developer carrying member rotates to feed the developer to a developing zone.

59. A device unit according to claim 58, wherein the developer is a one-component developer.

60. A device unit according to claim 59, wherein the one-component developer is triboelectrically charged due to friction with the developer carrying member.

* * * * *

UNITED STATES PATENT AND TRADEMARK OFFICE

CERTIFICATE OF CORRECTION

PATENT NO. : 5,547,724

DATED : August 20, 1996

INVENTOR(S) : TETSUYA KURIBAYASHI

It is certified that error appears in the above-identified patent and that said Letters Patent is hereby corrected as shown below:

ON COVER PAGE

AT [54] TITLE

"DEVELOPING DEVICE UNIT" should read
--DEVELOPING DEVICE AND DEVICE UNIT--.

AT [56] REFERENCES CITED

U.S. Patent Documents,
"Brewingtor et al." should read --Brewington et al.--.

AT [57] ABSTRACT

Line 7, "tains" should read --tains a--.

COLUMN 1

Line 2, "DEVELOPING DEVICE UNIT" should read
--DEVELOPING DEVICE AND DEVICE UNIT--.
Line 5, "8/193/776" should read --08/193,776--.

COLUMN 2

Line 1, "of" should be deleted.

COLUMN 3

Line 7, "render" should read --effect--.
Line 51, "also" should read --further--.
Line 56, "Carrying" should read --carrying--.

UNITED STATES PATENT AND TRADEMARK OFFICE

CERTIFICATE OF CORRECTION

PATENT NO. : 5,547,724

DATED : August 20, 1996

INVENTOR(S) : TETSUYA KURIBAYASHI

It is certified that error appears in the above-identified patent and that said Letters Patent is hereby corrected as shown below:

COLUMN 4

Line 32, "has" should read --have--.
Line 42, "toughening" should read --roughening--.

COLUMN 6

Line 29, "are" should read --is--.
Line 65, "Compounds" should read --compounds--.

COLUMN 7

Line 1, "form" should read --from--, and "0.005" should read --0.05--.
Line 22, "have" should be deleted.
Line 29, "toughening," should read --roughening,--.
Line 32, "toughening." should read --roughening.--.
Line 39, "Q" should read --l--.
Line 53, "represent" should read --represents--.
Line 60, "to" should be deleted.
Line 62, "to" should be deleted.

COLUMN 8

Line 26, "Separated" should read --separated--.
Line 33, "charges" should read --charge--.

COLUMN 9

Line 18, "end" should read --and--.

UNITED STATES PATENT AND TRADEMARK OFFICE

CERTIFICATE OF CORRECTION

PATENT NO. : 5,547,724

DATED : August 20, 1996

INVENTOR(S) : TETSUYA KURIBAYASHI

It is certified that error appears in the above-identified patent and that said Letters Patent is hereby corrected as shown below:

COLUMN 10

Line 15, "a" should read --an--.

COLUMN 11

Line 52, "toughened" should read --roughened--.

COLUMN 15

Line 47, "for" (first occurrence) should be deleted.

COLUMN 17

Line 46, "of" should read --of 20--.

COLUMN 20

Line 62, "a" should read --a--.

COLUMN 22

Line 61, "a" should read --a--.
Line 67, "toner," should read --toner.--.

UNITED STATES PATENT AND TRADEMARK OFFICE

CERTIFICATE OF CORRECTION

PATENT NO. : 5,547,724

DATED : August 20, 1996

INVENTOR(S) : TETSUYA KURIBAYASHI

It is certified that error appears in the above-identified patent and that said Letters Patent is hereby corrected as shown below:

COLUMN 24

Line 31, "W=[(100/(oil absorption of carbon black)) x100]xa" should read W=[{100/(oil absorption of carbon black)}x100]x<u>a</u>--.
Line 35, "a" should read --<u>a</u>--.
Line 51, "where" should read --wherein--.

Signed and Sealed this

Eighteenth Day of February, 1997

*Attest:*

*Attesting Officer*

Bruce Lehman

BRUCE LEHMAN

*Commissioner of Patents and Trademarks*